US008231016B2

(12) United States Patent
Berdahl et al.

(10) Patent No.: US 8,231,016 B2
(45) Date of Patent: Jul. 31, 2012

(54) PRODUCT DISPLAY SHELF APPARATUS AND METHOD

(75) Inventors: Katherine A. Berdahl, Chanhassen, MN (US); Tracie M. Kunz, Albertville, MN (US)

(73) Assignee: Target Brands, Inc., Minneapolis, MN (US)

( * ) Notice: Subject to any disclaimer, the term of this patent is extended or adjusted under 35 U.S.C. 154(b) by 182 days.

(21) Appl. No.: 12/631,063

(22) Filed: Dec. 4, 2009

(65) Prior Publication Data

US 2011/0132854 A1 Jun. 9, 2011

(51) Int. Cl.
*A47G 29/087* (2006.01)

(52) U.S. Cl. ..... 211/119.003; 40/657

(58) Field of Classification Search ..... 211/119.003, 211/183, 86.01, 113; 40/611.08, 618, 649, 40/657, 661.03, 611.06
See application file for complete search history.

(56) References Cited

U.S. PATENT DOCUMENTS 561,231 A * 6/1896 Lean ..... 40/611.05
1,781,258 A * 11/1930 Walker ..... 101/128
1,964,484 A * 6/1934 Schroeder ..... 40/611.08
2,169,290 A * 8/1939 Umberto ..... 40/765
2,888,146 A * 5/1959 Teas, Jr. ..... 211/86.01
3,664,626 A * 5/1972 Sneller ..... 248/224.7
3,741,131 A * 6/1973 Leadbetter ..... 108/97
3,829,995 A * 8/1974 Fakoury ..... 40/649
4,041,630 A * 8/1977 Holbrook ..... 40/765
4,140,224 A * 2/1979 Celeste ..... 211/134
4,593,486 A * 6/1986 Visocky et al. ..... 40/490
4,709,891 A * 12/1987 Barnett ..... 248/214
4,729,183 A * 3/1988 Tarter et al. ..... 40/766
4,821,437 A * 4/1989 Abramson et al. ..... 40/658
4,881,707 A * 11/1989 Garfinkle ..... 248/222.12
4,995,182 A * 2/1991 Fast ..... 40/649
5,253,835 A * 10/1993 Herron, III ..... 248/220.22
5,257,472 A * 11/1993 Harnois et al. ..... 40/611.05
5,421,113 A * 6/1995 Gebka et al. ..... 40/642.01
5,437,514 A * 8/1995 Minch ..... 402/79
5,722,623 A * 3/1998 Gibson ..... 248/201
5,832,644 A * 11/1998 Mason ..... 40/642.02
5,924,367 A * 7/1999 Henke et al. ..... 108/108
5,931,316 A * 8/1999 Carpinelli ..... 211/50
6,289,618 B1 * 9/2001 Kump et al. ..... 40/657
6,315,134 B1 * 11/2001 Stuart ..... 211/87.01
6,354,546 B1 * 3/2002 Mueller ..... 248/220.42
6,434,871 B2 * 8/2002 Conway ..... 40/651
6,438,880 B2 * 8/2002 Dundorf ..... 40/618
6,470,611 B1 * 10/2002 Conway et al. ..... 40/606.14
6,688,567 B2 * 2/2004 Fast et al. ..... 248/220.41
6,796,064 B2 * 9/2004 Gibson et al. ..... 40/606.15

(Continued)

OTHER PUBLICATIONS

Trio T-Shirt Display [Online] [Retrieved from the Internet on Dec. 4, 2009] at URL http://www.triodisplay.com/catalog/tshirt-display-c-1254.html, Sep. 9, 2009, 3 pages.

*Primary Examiner* — Darnell Jayne
*Assistant Examiner* — Devin Barnett
(74) *Attorney, Agent, or Firm* — Griffiths & Seaton PLLC

(57) ABSTRACT

Some embodiments of a product display shelf apparatus include at least one shelf to receive a plurality of image-bearing products while a product signage assembly is removably attached to the shelf. The product signage assembly can be toollessly assembled to the shelf such that an image display panel exhibits images that generally match those of the image-bearing products.

15 Claims, 13 Drawing Sheets

U.S. PATENT DOCUMENTS 6,811,044 B2 * 11/2004 Walker ..... 211/119.003
6,860,051 B2 * 3/2005 Knauf ..... 40/649
6,862,827 B2 * 3/2005 Gregory ..... 40/661
6,976,331 B2 * 12/2005 Fast ..... 40/661.03
7,055,274 B2 * 6/2006 Fast et al. ..... 40/661.03
7,216,445 B2 5/2007 Bruegmann
7,340,855 B2 * 3/2008 Wiltfang et al. ..... 40/611.03
7,739,820 B2 * 6/2010 Frank ..... 40/647
2002/0170870 A1 * 11/2002 Callis ..... 211/119.003
2003/0029824 A1 * 2/2003 Weiler ..... 211/184
2005/0035075 A1 * 2/2005 Walker ..... 211/119.003
2006/0225597 A1 * 10/2006 Cohen et al. ..... 101/494
2007/0251905 A1 * 11/2007 Trotta ..... 211/119.003
2008/0141575 A1 * 6/2008 Keating ..... 40/661.11
2009/0001037 A1 * 1/2009 Wilcock ..... 211/119.003

* cited by examiner

PRODUCT DISPLAY SHELF APPARATUS AND METHOD

TECHNICAL FIELD

This disclosure relates to a product display shelf apparatus and related methods for use, in some examples, in a retail store environment.

BACKGROUND

Display shelf fixtures can be used in retail stores to present various products to consumers. The display shelf fixtures may retain the product packages thereon in view of the consumers. For example, clothing apparel items, fashion accessories, cosmetics, food items, books and magazines, home improvement products, cleaning products, and other products may be displayed on shelves of a designated fixture. Such a display shelf fixture can be arranged along an aisle in a store so that consumers walking by the fixture can readily grasp selected products.

In some circumstances, the display shelf fixture provides horizontal shelves to support products such as clothing or other items that bear graphic images. When these image-bearing products are folded or stacked on a horizontal shelf, the particular graphic images on the products may not be readily viewable to a consumer passing by the display shelf fixture. For example, some display shelf fixtures include a set of horizontal shelves to support folded stacks of shirts to consumers. The shirts that are folded into the stacks may each bear a graphic image that is, for example, screen printed thereon. Because the shirts are arranged in stacks on a horizontal shelf surface, a consumer that is passing several feet away from a front side of the display shelf fixture may be unable to promptly view all of the different graphic images that are borne by the shirts.

In addition, the products that are arranged on the horizontal shelf surfaces of the display shelf fixtures can be replaced on a regular basis. For example, during a seasonal inventory change, stacks of image-bearing shirts on a horizontal shelf surface may be replaced with stacks of new shirts bearing new graphic images. In such circumstances, the consumers may be unaware that the new products arranged on the display shelf fixture have a different appearance (e.g., bear different graphic images) from the previous products that were displayed only days or hours earlier.

SUMMARY

Some embodiments of a product display shelf apparatus support a plurality of products in an appealing manner that draws attention from consumers. In particular embodiments, the product display shelf apparatus includes at least one shelf to receive a plurality of image-bearing products while a product signage assembly is removably attached to the shelf. In such embodiments, the product signage assembly is toollessly assembled to the shelf such that an image display panel is vertically oriented forward of a front face of the shelf. The image display panel is optionally configured to removably receive graphic inserts having images that generally match those of the image-bearing products. Thus, some embodiments of the product display shelf apparatus enable consumers to promptly view the variety of graphic images borne by the products on the display shelf even when the consumers are positioned a substantial distance away from a front side of the display shelf apparatus (a distance that might otherwise prevent the consumers from clearly viewing the actual products arranged on the shelf). Moreover, in the embodiments in which the product signage assembly removably receives the graphic inserts, a store worker can efficiently install new graphic inserts into the product signage assembly when the inventory of products on the shelf is modified.

These and other embodiments described herein may provide one or more of the following benefits. First, some embodiments of the product display shelf apparatus described herein are configured to contemporaneously display a variety of products and images related to those products in a manner that permits convenient and prompt viewing by consumers. Second, particular embodiments of the product display shelf apparatus include separate members that are toollessly mounted together to form a product signage assembly positioned forward of a front face of one or more display shelves. As such, a store worker can readily assemble the display shelf apparatus without requiring handheld tools. Third, in some embodiments, the display shelf apparatus is configured to removably receive a plurality of graphic panels displaying images that match graphic images borne on the products on the display shelf. Accordingly, when the inventory of the products on the display shelf is replaced or modified, the store worker can readily replace the graphic panels so as to display new images that match the graphic images borne on the new products on the display shelf. Some or all of these and other benefits may be provided by the apparatus and methods described herein.

The details of one or more embodiments of the invention are set forth in the accompanying drawings and the description below. Other features, objects, and advantages of the invention will be apparent from the description and drawings, and from the claims.

DETAILED DESCRIPTION OF ILLUSTRATIVE EMBODIMENTS

Figure 1:
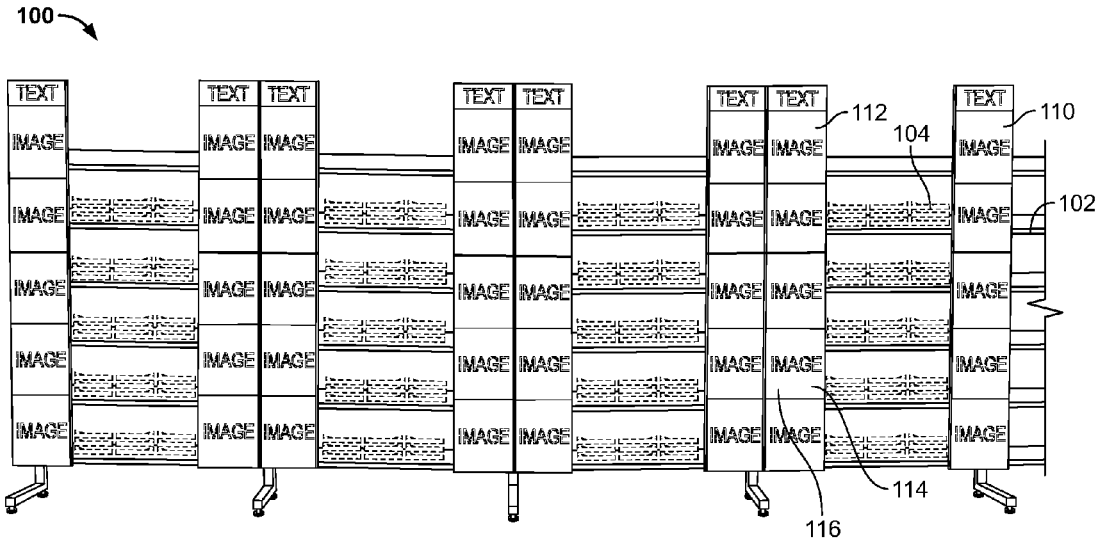
FIG. 1 is a front view of a product display shelf apparatus, in accordance with some embodiments.

Referring to FIG. 1, some embodiments of a product display shelf apparatus 100 include one or more product signage assemblies 110 attached to a plurality of display shelves 102. The display shelves 102 retain a plurality of merchandise products 104 in a manner that allows consumers to readily access the merchandise products 104. In some embodiments, the merchandise products 104 are apparel items arranged in stacks. In the example shown in FIG. 1, the merchandise products 104 are t-shirts bearing a variety of graphic images, such as screen-printed images of artwork, logos, text, or a combination thereof. In some embodiments, the merchandise products 104 take the form of other apparel items, such as jackets, sweatshirts, sweaters, hats, gloves, dresses, or pants. In other embodiments, the merchandise products 104 are items other than apparel items, such as coffee mugs, backpacks, mouse pads, posters, sporting goods (e.g. basketballs, skateboards, etc.), housewares, or home decor items. As described in more detail below, each product signage assembly 110 is toollessly mounted to one or more of the display shelves 102 such that the product signage assembly 110 is vertically oriented in a position forward of the display shelves 102. Further, each product signage assembly 110 is configured to removably receive an image panel 114 providing an image that matches a graphic image borne on one or more of the products 104. Accordingly, the product display shelf apparatus 100 attracts consumers to promptly view the variety of graphic images borne by the products 104 stacked on the display shelves 102 even when the consumers are positioned away from a front side of the display shelf apparatus (a distance that might otherwise prevent the consumers from clearly viewing the actual product arranged on the shelf).

Briefly, in use, the product signage assemblies 110 toollessly attach to one or more of the display shelves 102. The merchandise products 104 retained on the display shelves 102 include a variety of logos, artwork, printed text, or other graphic images. Each of the product signage assemblies 110 display images 112 that correspond to images borne on the merchandise products 104 stacked on the shelves 102. For example, each product signage assembly 110 is configured to removably receive a plurality of image panels 114 (FIGS. 2-3) having a front face that displays one of the images 112. In some embodiments, the merchandise products 104 are positioned on the display shelves 102 so that merchandise products 104 bearing particular images are positioned relative to matching images 112 displayed by the product signage assemblies 100. The images 112 on the panels 114 are highly visible to consumers passing by the product display shelf apparatus 100 and are therefore more likely to attract the attention of consumers. Thus, the image panels 114 can be functionally related to the graphic images borne on the products 104 in that the images 112 that are vertically oriented on the product signage assemblies 110 allow consumers to quickly and easily compare images contained on a variety of merchandise products 104 without having to separately examine each merchandise product 104 on the shelves 102. For example, in embodiments in which the merchandise products 104 are t-shirts, the images 112 displayed by the product signage assemblies 110 allow a consumer to decide on a particular style oft-shirt without having to unfold and look at a number of t-shirts. Additionally, the product signage assemblies 110, allow a consumer to readily compare multiple images in a side-by-side arrangement while deciding on which merchandise products 104 to purchase.

Figure 2:
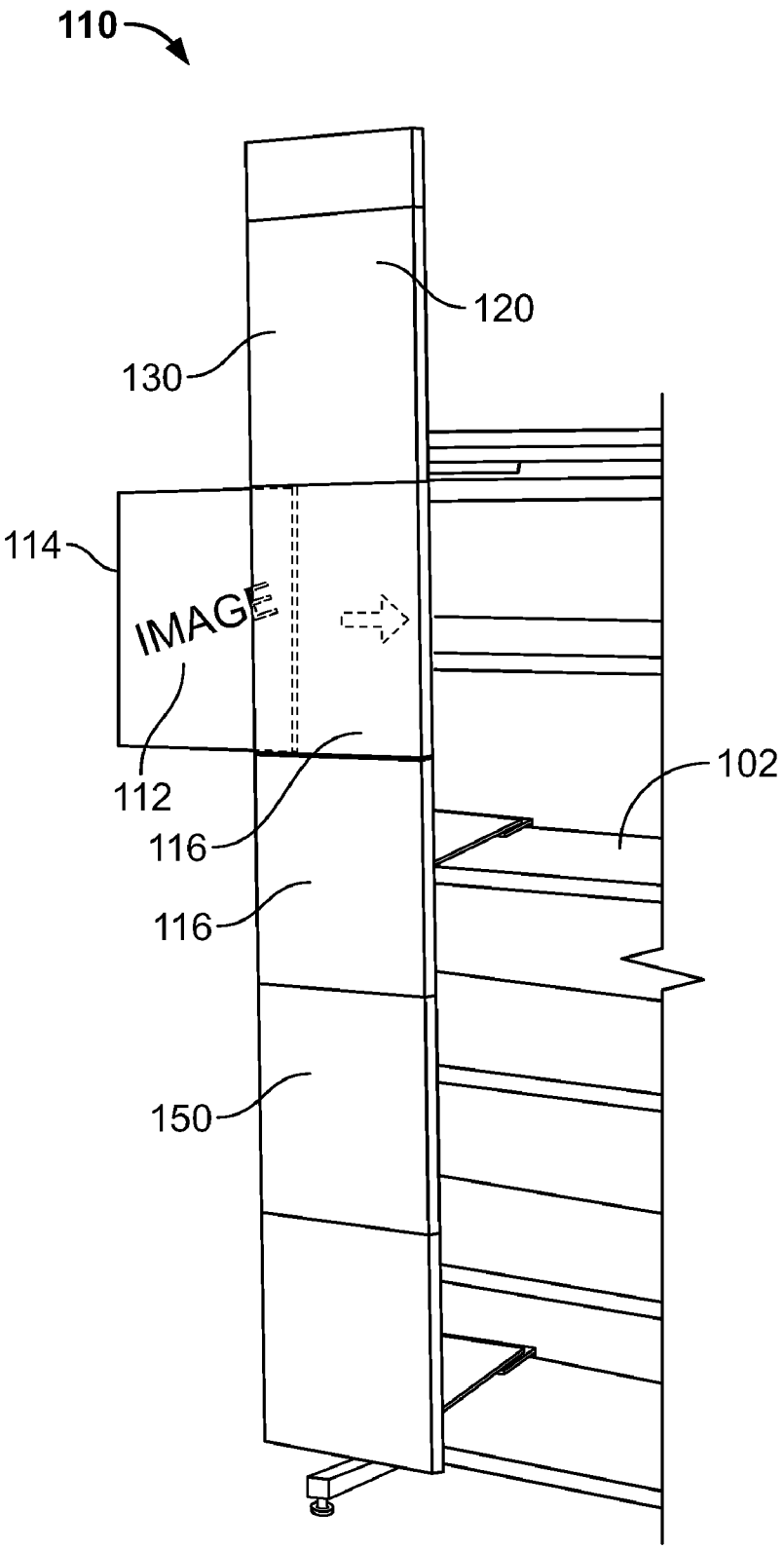
FIG. 2 is a front perspective view of a portion of the product display shelf apparatus of FIG. 1.
Figure 3:
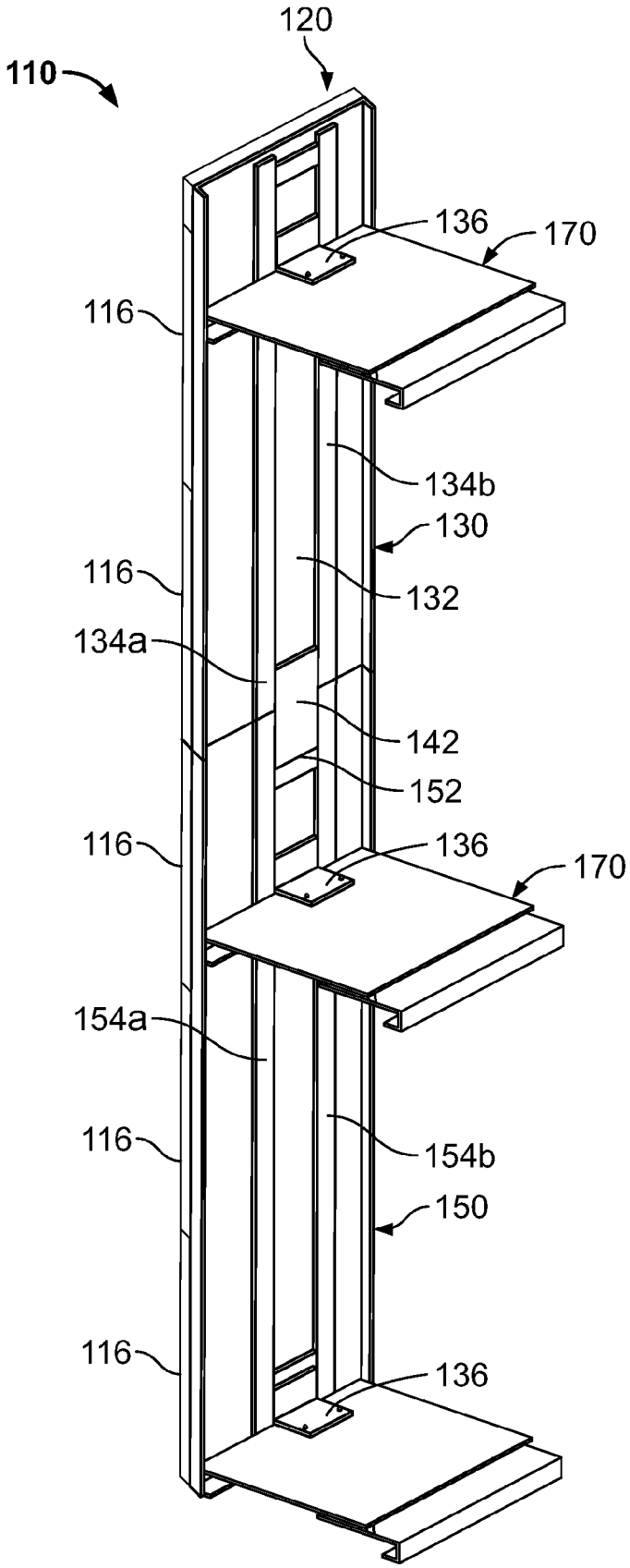
FIG. 3 is a rear perspective view of a product signage assembly of the product display shelf apparatus of FIG. 1.

Referring now to FIGS. 2-3, in some embodiments, the images 112 are printed or otherwise disposed on image panels 114 that are inserted into transparent receiving sleeves 116 on the front faces of the product signage assemblies 110. For example, the image panels 114 are constructed of paper, paperboard, cardboard, plastic, fabric, or another suitable material that bears the images 112. The transparent receiving sleeves 116 allow image panels 114 to be readily removed and inserted into the product signage assemblies 110 in order to change the appearance of the apparatus 100 (e.g., when changing or modifying the inventory of products 104 on the shelves 102). For example, the products 104 may include a number of t-shirts and jackets bearing logos of various baseball teams and are arranged on the shelves 102 to correspond with baseball season. In this example, the image panels 114 having images 112 that correspond to the team logos borne on the t-shirts and jackets are inserted into the transparent receiving sleeves 116. When football season starts, the remaining inventory oft-shirts and jackets are removed from the shelves 102 and replaced with new merchandise products 104 including t-shirts, jackets, and jerseys bearing logos of various football teams. In these circumstances, the image panels 114 having images 112 that correspond to the baseball team logos are slidably removed from the receiving sleeves 116 and replaced with new image panels 114 having images 112 that correspond to the football team logos borne on the new merchandise products 104.

In this embodiment, the product signage assembly 110 is retained in an operative position that is generally perpendicular to each of the corresponding horizontal shelves 102 and forward of the front face of each of the corresponding horizontal shelves 102. In such circumstances, the image panels 114 are retained by the receiving sleeves 116 of the product signage assembly 110 so that the image panels 114 are arranged in a vertical orientation forward of the front face of each of the corresponding horizontal shelves 102. In the embodiment depicted in FIGS. 1-2, when the image panels 114 are retained in this manner, the image panels 114 are configured to extend in a plane that is generally parallel to the front face of each of the corresponding horizontal shelves 102.

Referring to FIGS. 1-3, in accordance with some embodiments, some (but not necessarily all) of the image panels 114 include images 112 other than images that correspond to images borne on the products 104. In some such embodiments, some or all of the images 112 include information about sales promotions, items displayed on the product display shelf apparatus 100, other items located within the store, brand logos, decorative images, or text. For example, if the merchandise products 104 are various brands of jeans, some of the images 112 include logos and brand names associated with the various brands of jeans. Other images 112 include information on sizes to allow a consumer to readily identify the correct size of jeans. As another example, some of the images 112 include logos associated with a store in which the retail display is located. As yet another example, some of the images 112 include text informing consumers of a sale price for some or all of the merchandise products 104. In some implementations, the images 112 include images of the merchandise products 104 in use. For example, one of the images 112 is a picture of a person wearing a t-shirt of the same style as t-shirts located on the shelves 102.

In some alternative embodiments, the images 112 are displayed on the product signage assemblies 110 in a manner other than inserting image panels 114 into transparent receiving sleeves 116. For example, in one embodiment, the image panels 114 are attached to the product signage assemblies 110 using VELCRO. As another example, the image panels 114 are attached to the product signage assemblies 110 using one or more fasteners. As yet another example, double-sided tape is used to attach the image panels 114 to the product signage assemblies 110. In some embodiments, the images 112 are printed on cloth pieces. The cloth pieces are attached to the product signage assemblies 110 in any of the manners described above with respect to the image panels 114. In some embodiments, the images 112 are printed directly onto the product signage assemblies 110. In some embodiments, the images 112 are printed onto sample shirts, and the sample shirts are retained on the product signage assemblies 110. For example, a sample shirt is folded to form a square so that the image on the sample shirt is visible on the square. The sample shirt is then inserted into one of the transparent receiving sleeves 116. As another example, shirts bearing images 112 are attached to the product signage assemblies 110 using glue, tape, VELCRO, or fasteners.

Referring now to FIGS. 3-8, in some embodiments, some or all of the product signage assemblies 110 are toollessly mounted to the one or more shelves 102 so as to provide prompt installation by a store worker and to provide the opportunity to readily change the appearance of the product display shelf apparatus 100. In some embodiments, some or all of the product signage assemblies 110 are removed and replaced with product signage assemblies having different shapes or sizes in order to change the appearance of the product display shelf apparatus 100.

Figure 4:
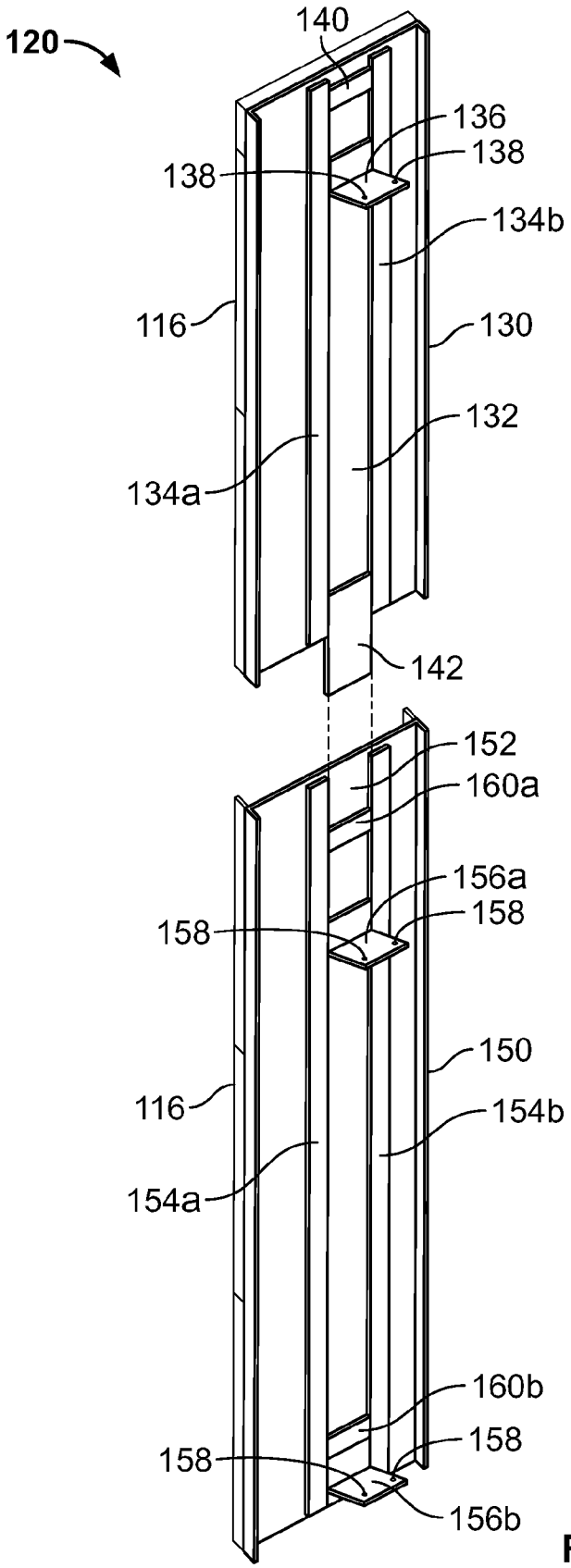
FIG. 4 is an exploded view of upper and lower sign panels of the product signage assembly of FIG. 1.

Referring to FIGS. 3-4, in accordance with some embodiments, a signage portion 120 of a product signage assembly 110, such as those shown in FIG. 1, includes an upper sign panel 130 and a lower sign panel 150. The upper sign panel 130 includes a channel 132 formed by guide rails 134*a* and 134*b* attached to a backside of the upper sign panel 130. In some embodiments, the guide rails 134*a-b* are substantially straight, metal or plastic pieces positioned so as to form the channel 132. The channel 132 receives a rear bracket 136. The rear bracket 136 is configured to engage a mounting portion 170 of the product signage assembly 110. The mounting portion 170 is described in greater detail below with reference to FIGS. 5-7. In some embodiments, the rear bracket 136 is formed from metal, wood, fiber board, or molded plastic. The channel 132 slidably receives the rear bracket 136 to allow the position of the rear bracket 136 to be adjusted in order to allow the upper sign panel 130 to be attached to shelving units having varying shelf heights. For example, a user, such as a store worker, of the product signage assembly 110 slides the rear bracket 136 within the channel 132 until the rear bracket 136 is located at a desired position. In some embodiments, the rear bracket 136 is held in position within the channel 132 by a friction fit with the guide rails 134*a-b*. In other embodiments, the rear bracket 136 is held in position using fasteners. For example, thumb screws are used to hold the rear bracket 136 in place. The rear bracket 136 includes apertures 138 for engaging fasteners of the mounting portion 170 as will be described in greater detail below with reference to FIG. 6. In some embodiments, the upper sign panel 130 includes multiple rear brackets 136 positioned within the channel 132.

As shown in FIG. 4, in some embodiments, the upper sign panel 130 includes a channel end piece 140 positioned within the channel 132 between the guide rails 134*a-b*. The channel end piece 140 prevents the rear bracket 136 from sliding out of the top of the channel 132. In some embodiments, the channel end piece 140 is positioned so as to establish a maximum upper position for the rear bracket 136. In some embodiments, the channel end piece 140 is detachable. In some embodiments, the channel end piece 140 is repositionable to allow the maximum upper position for the rear bracket 136 to be changed.

In some embodiments, the upper sign panel 130 includes a tab 142 for engaging the lower sign panel 150 and securing the upper sign panel 130 to the lower sign panel 150. In the example depicted, the tab 142 is positioned within a lower portion of the channel 132. In some embodiments, the tab 142 is held in a fixed position within the channel 132. For example, the tab 142 is held in place with fasteners, or is welded into place. In some embodiments, the tab 142 is slidably mounted within the channel 132, allowing the position of the tab 142 to be adjusted. In some embodiments, the upper sign panel 130 includes multiple tabs 142 for engaging the lower sign panel 150. In the example shown, the tab 142 is positioned so that a portion of the tab 142 extends in a downward direction beyond the main body of the upper sign panel 130. The portion of the tab 142 that extends beyond the main body of the upper sign panel 130 is configured to engage a channel 152 of the lower sign panel 150 and hold the upper sign panel 130 in an operable position with respect to the lower sign panel 150.

In the example shown, the channel 152 has a substantially similar width to that of the channel 132. The channel 152 is formed by guide rails 154*a* and 154*b*. The guide rails 154*a-b* receive the extending portion of the tab 142 in order to secure the upper sign panel 130 to the lower sign panel 150 to form the signage portion 120 of the product signage assembly 110. This allows the upper sign panel 130 to be toollessly mounted to the lower sign panel 150. In some embodiments, the tab 142 is secured within the channel 152 by a friction fit with the guide rails 154*a-b*. In some embodiments, the tab 142 is secured within the channel 152 with fasteners. The channel 152 receives rear brackets or slidable arms 156*a* and 156*b*. The rear brackets 156*a-b* are configured to engage mounting portions 170 of the product signage assembly 110. The mounting portions 170 are described in greater detail below with reference to FIGS. 5-7. In some embodiments, the rear brackets 156*a-b* are formed from metal, wood, fiber board, or molded plastic. In some embodiments, the rear brackets 156*a-b* are substantially identical to the rear bracket 136 of the upper sign panel 130. The channel 152 slidably receives the rear brackets 156*a-b* to allow the positions of the rear brackets 156*a-b* to be adjusted in order to allow the lower sign panel 150 to be attached to shelving units having varying shelf heights. For example, a user, such as a store worker, of the product signage assembly 110 slides the rear bracket 156*a* within the channel 152 so that the distance between the rear bracket 156*a* and the rear bracket 156*b* is approximately equal to the distance between two shelves of a retail display unit. In some embodiments, the rear brackets 156*a-b* are held in position within the channel 152 by a friction fit with the guide rails 154*a-b*. In other embodiments, the rear brackets 156*a-b* are held in position using fasteners. For example, thumb screws are used to hold the rear bracket 156*b* in place. The rear brackets 156*a-b* include apertures 158 for engaging fasteners of the mounting portions as will be described in greater detail below with reference to FIG. 6.

Still referring to FIG. 4, in some embodiments, the lower sign panel 150 includes channel end pieces 160*a* and 160*b* positioned within the channel 152 between the guide rails 154*a-b*. The channel end pieces 160*a-b* define sliding areas for the rear brackets 156*a-b* within the channel 152. For example, in some embodiments, the channel end piece 160*a* is positioned so as to establish a maximum upper position for the rear bracket 156*a* and the channel end piece 160*b* is positioned so as to establish a minimum lower position for the rear bracket 156*a*. In this example, the range of possible positions for the rear bracket 156*a* is defined within the channel 152 between the channel end pieces 160*a* and 160*b*. As another example, the channel end piece 160*b* is positioned so as to establish a maximum upper position for the rear bracket 156*b*. In the example depicted, the channel end piece 160*b* is positioned near the bottom of the channel 152 so as to limit the possible positions of the rear bracket 156*b* to locations near the bottom of the lower sign panel 150. In some embodiments, the rear bracket 156*b* is held in a fixed position (e.g. with fasteners or by welding) and the rear bracket 156*a* is moved in order to adjust the distance between the rear brackets 156*a* and 156*b*. In some embodiments, the channel end pieces 160*a-b* are detachable. In some embodiments, the channel end pieces 160*a-b* are repositionable to allow the range of possible positions for the rear brackets 156*a-b* as defined by the channel end pieces 160*a-b* to be adjusted.

Figure 5:
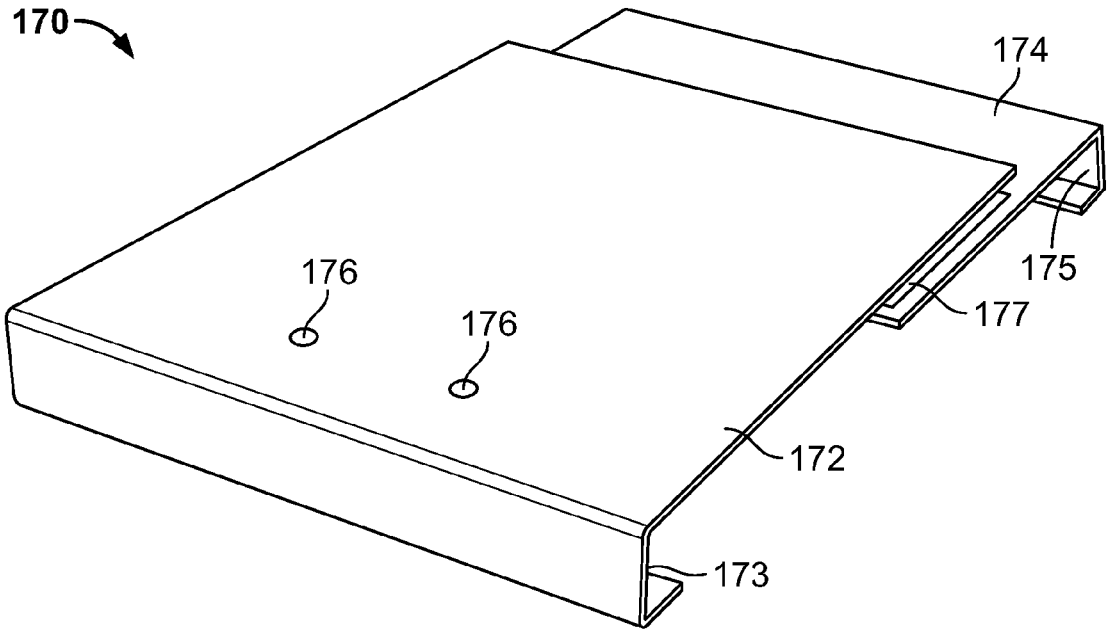
FIG. 5 is a perspective view of front and rear mounting portions of the product signage assembly of FIG. 1.

Referring now to FIG. 5, in accordance with some embodiments, the mounting portion 170 of the product signage assembly 110 includes a front mounting portion or front element 172 and a rear mounting portion or rear element 174. The mounting portion 170 is configured to couple to one of the rear brackets 136, 156*a*, or 156*b* of the signage portion 120 of the product signage assembly 110. A rear part of the rear mounting portion 174 defines a channel 175 for engaging a rear face of a shelf. The channel 175 engages upper, rear, and lower faces of the shelf in order to secure the rear mounting portion 174 to the shelf. The channel 175 forms a friction fit with the shelf in order to hold the rear mounting portion 174 in an operable position with respect to the shelf. In some embodiments, one or more of the inner surfaces of the channel 175 are equipped with gripping pads in order to better enable the friction fit between the rear mounting portion 174 and the shelf. For example, the inner surfaces of the channel 175 include rubber, plastic, or foam gripping pads.

As shown in FIG. 5, the front mounting portion 172 engages the rear mounting portion 174 by partially covering a top surface of the rear mounting portion 174. In some embodiments, the front mounting portion 172 is releasably secured to the rear mounting portion 174 by a toolless connector 177, such as VELCRO, double-sided tape, putty, clips, friction-fit fasteners, or the like. The position of the front mounting portion 174 with respect to the rear mounting portion 172 is adjustable to accommodate shelves of varying depths. The front mounting portion defines a channel 173 for engaging a front face of a shelf. The channel 173 engages upper, front, and lower faces of the shelf in order to secure the front mounting portion 172 to the shelf. The channel 173 forms a friction fit with the shelf in order to hold the front mounting portion 172 in an operable position with respect to the shelf. In some embodiments, one or more of the inner surfaces of the channel 173 are equipped with gripping pads in order to better enable the friction fit between the front mounting portion 172 and the shelf. For example, the inner surfaces of the channel 173 include rubber, plastic, or foam gripping pads.

The front mounting portion 172 includes apertures 176 for receiving fasteners. The fasteners enable the rear brackets 136, 156*a*, and 156*b* of the signage portion 120 (FIG. 2) to securely attach to the mounting portion 170. For example, screws are inserted through the apertures 176 so that the threaded portions of the screws are facing upward. The rear bracket 136 (FIG. 2) is secured to the mounting portion 170 by aligning the apertures 138 of the rear bracket 136 with the apertures 176 and inserting the screws through the apertures 138. In this example, the rear bracket 136 is held in place by tightening nuts onto the ends of the screws.

Figure 6:
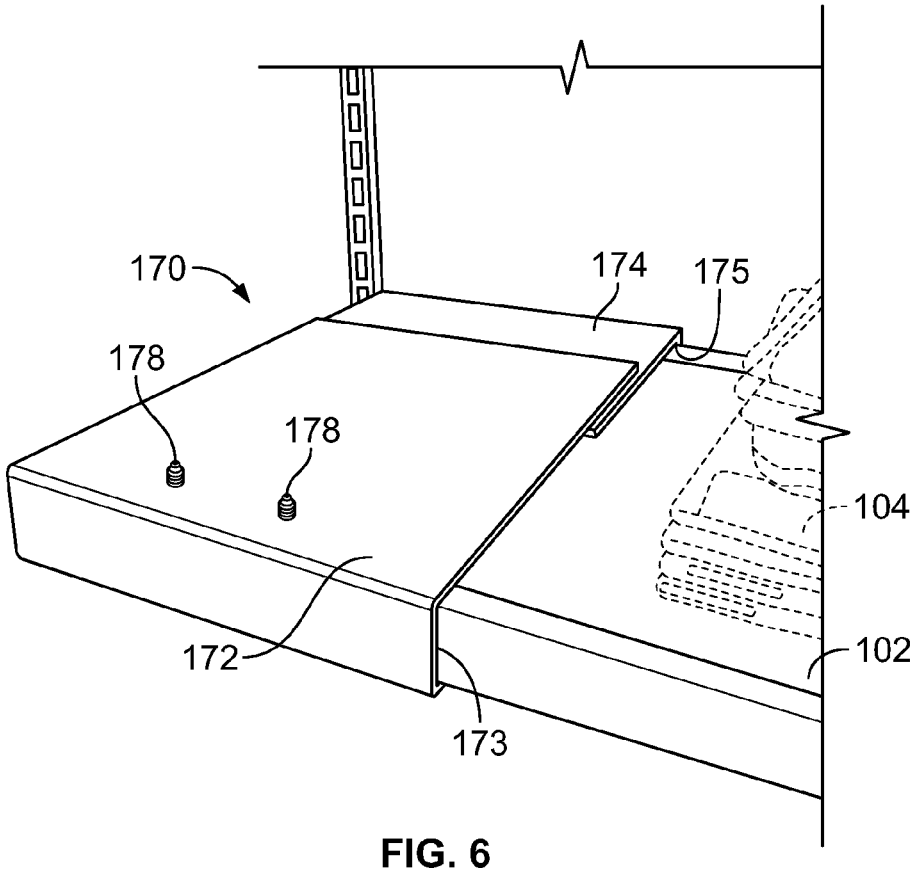
FIG. 6 is a perspective view of the front and rear mounting portions of FIG. 5 attached to a shelf, in accordance with some embodiments.

Referring now to FIG. 6, the mounting portion 170 is shown in an operable position with respect to a shelf 102. The channel 175 of the rear mounting portion 174 engages upper, rear, and bottom surfaces of the shelf 102 in order to form a friction fit. In some embodiments, the width of the channel 175 is adjustable in order to accommodate shelves of different widths. For example, the channel 175 is defined by two slidably engaged pieces. The two pieces are slid with relation to each other in order to adjust the width of the channel 175 to match the width of the shelf 102. In some embodiments, the rear mounting portion 174 includes a cranking mechanism for adjusting the width of the channel 175. As shown in FIG. 4, the front mounting portion 172 is positioned on the shelf 102 such that a portion of the front mounting portion 172 partially or completely covers the top surface of the rear mounting portion 174. The front mounting portion 172 is positioned so that the channel 173 engages upper, front, and bottom surfaces of the shelf 102. In some embodiments, the width of the channel 173 is adjustable as described above for the channel 175 to allow the width of the channel 173 to be adjusted to match the width of the shelf 102. The front mounting portion 172 couples to the rear mounting portion 174 to form a secure fit on the shelf 102. For example, VELCRO pads on the bottom of the front mounting portion 172 engage VELCRO pads on the top of the rear mounting portion 174. As another example, double-sided tape is attached to the underside of the front mounting portion 172. When the front mounting portion 172 is positioned relative to the rear mounting portion 174, the double-sided tape contacts the top surface of the rear mounting portion 174, securely coupling the front mounting portion 172 to the rear mounting portion 174.

Still referring to FIG. 6, in accordance with some embodiments, fasteners 178 are inserted through the apertures 176 of the front mounting portion 174. For example, friction-fit fasteners are inserted through the apertures 176. A store worker aligns the apertures 138 of the rear bracket 136 with the friction-fit fasteners. The store worker then presses down on the rear bracket 136 to cause the friction-fit fasteners to pass through the apertures 138. This causes the rear bracket 136 to snap into an operative position with respect to the mounting portion 170. This functionality of the friction-fit fasteners allows a store worker to toollessly mount the upper sign panel 130 or the lower sign panel 150 to the mounting portion 170.

Figure 7:
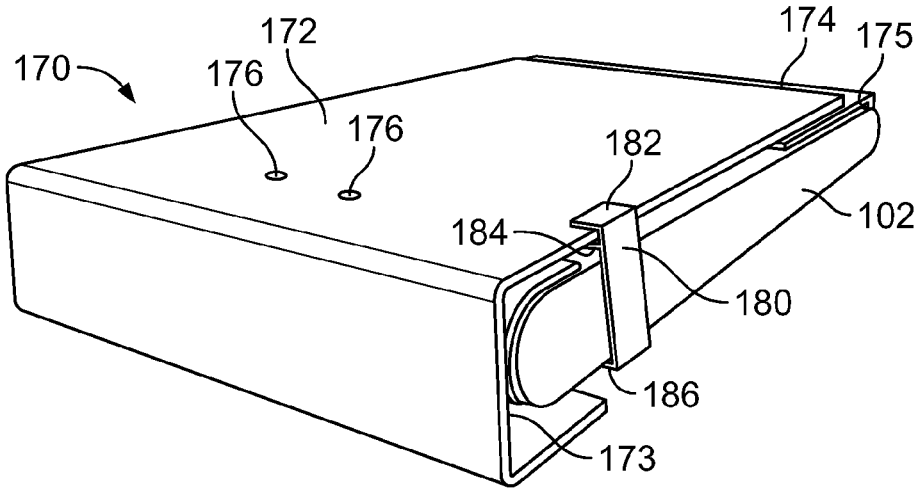
FIG. 7 is a perspective view of the front and rear mounting portions of FIG. 3 attached to a shelf using a shelf mounting clip, in accordance with some embodiments.

Referring now to FIG. 7, in accordance with some embodiments, a mounting portion 170 is secured to a shelf 102 at the edge of the shelf 102. In the example shown, a shelf clip 180 is attached to a side of the front mounting portion 172 in order to securely hold the mounting portion 170 in an operable position with respect to the shelf 102. The shelf clip 180 includes a top extending portion 182 and a middle extending portion 184 that form a friction fit with the front mounting portion 172. The top extending portion 182 contacts a top surface of the front mounting portion 172 and the middle extending portion 184 contacts a bottom surface of the front mounting portion 172. In some embodiments, the top extending portion 182 and the middle extending portion 184 include gripping pads or gripping extensions extending towards the front mounting portion 172 in order to increase the friction between the shelf clip 180 and the front mounting portion 172.

In addition to contacting the bottom surface of the front mounting portion 172, the middle extending portion 184 of the shelf clip 180 also contacts a top surface of the shelf 102. The shelf clip further includes a bottom extending portion 186 for contacting a bottom surface of the shelf 102. The middle extending portion 184 and the bottom extending portion 186 engage the shelf 102 to form a friction fit. By forming friction fits with both the front mounting portion 172 and the shelf 102, the shelf clip 180 secures the mounting portion 170 in an operable position and helps to ensure that the edge of the mounting portion 170 is aligned with the edge of the shelf 102. In some embodiments, shelf clips 180 are not used to secure the mounting portion 170 in an operable position with relation to the shelf 102. For example, in a situation where the mounting portion 170 is mounted in the middle of the shelf 102 and not near the edge of the shelf 102, the shelf clip 180 is not used to secure the mounting portion 170 to the shelf 102. In some embodiments, multiple shelf clips 180 are used to secure the mounting portion 170 to the shelf 102.

Figure 8:
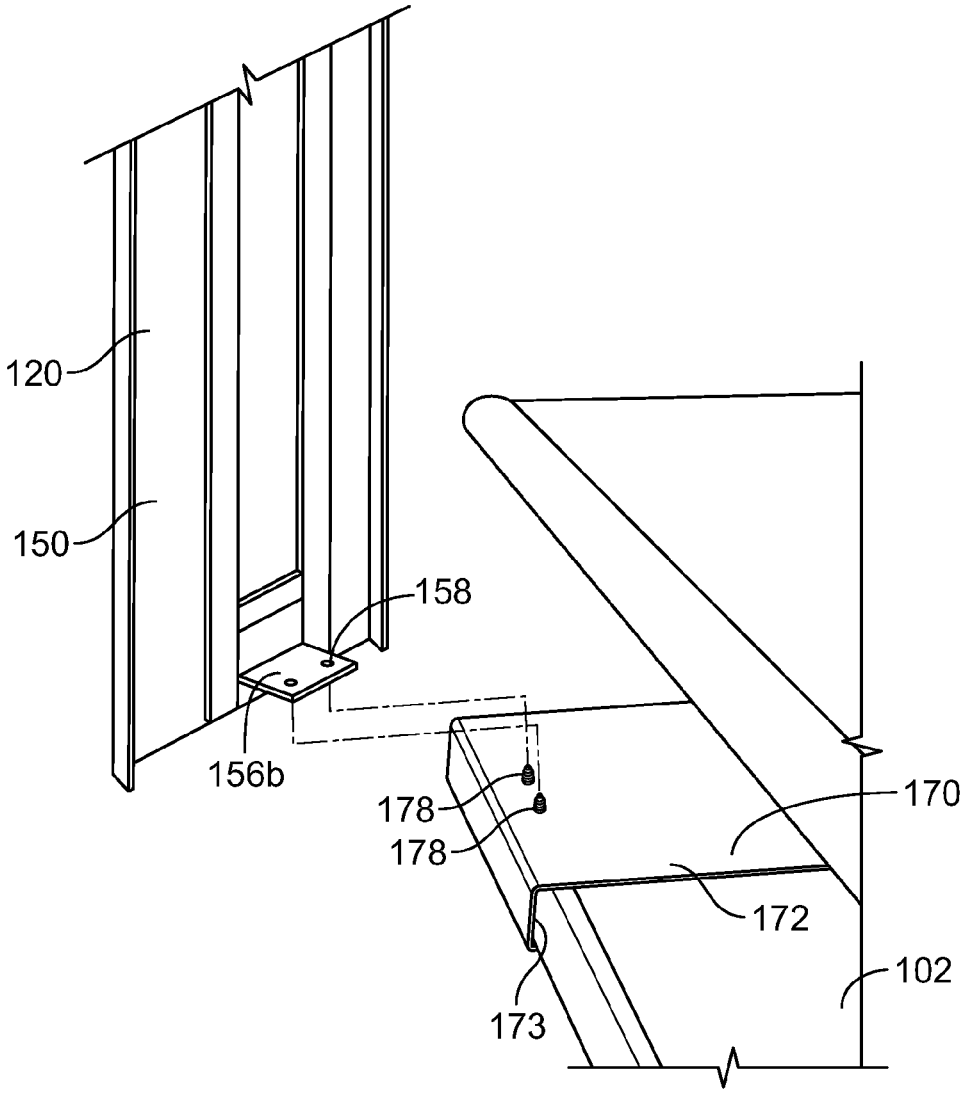
FIG. 8 is an exploded view of the lower sign panel of FIG. 4 in relation to the front mounting portion of FIG. 5.

Referring now to FIG. 8, in accordance with some embodiments, the mounting portion 170 is secured to the shelf 102. Fasteners 178 are inserted through the apertures 176 so that the fasteners 178 are extending upward from the front mounting portion 172. The lower sign panel 150 is positioned so that the apertures 158 of the rear bracket 156*b* are aligned with the fasteners 178. The lower sign panel 150 is secured to the mounting portion 170 by moving the lower sign panel 150 in a downward direction so as to cause the fasteners 178 to extend through the apertures 158. In some embodiments, the fasteners 178 toollessly snap into place so as to fit securely within the apertures 158. For example, friction-fit fasteners allow for the apertures 158 to easily pass over the fasteners in one direction, but not in the opposite direction, therefore holding the lower sign panel 150 in place with respect to the mounting portion 170. In some embodiments, the fasteners 178 form a friction fit with the rear bracket 156*b* in order to hold the lower sign panel 150 in position. The friction fit allows the lower sign panel 150 to be toollessly attached to or removed from the mounting portion 170. In some embodiments, nuts or washers are used to secure the rear bracket 156*b* to the fasteners 178. For example, if the fasteners 178 are bolts, nuts are screwed onto the ends of the fasteners 178 and tightened until the rear bracket 156*b* is secured to the mounting portion 170.

Figure 9:
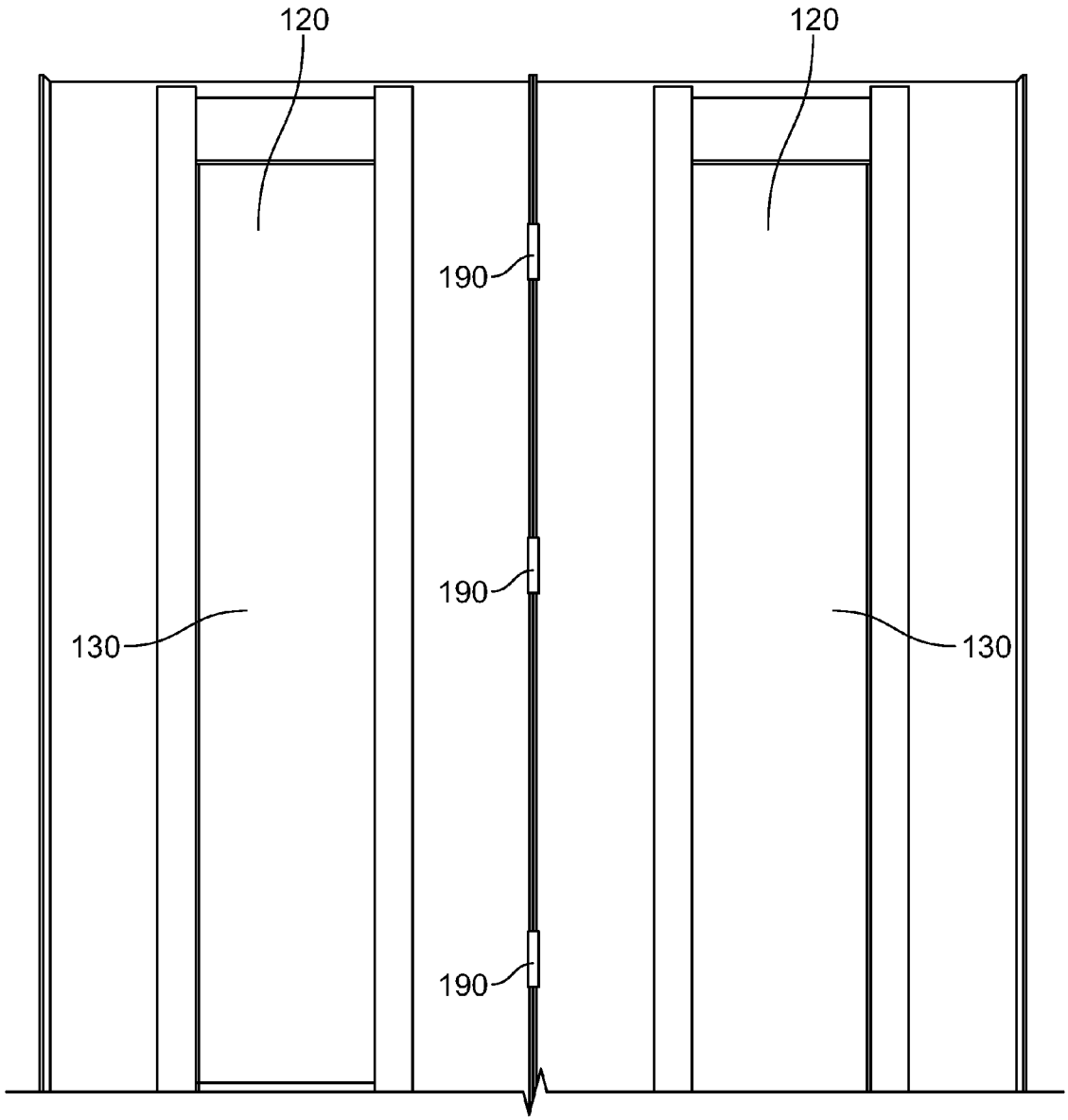
FIG. 9 is a rear view of two sign panels of FIG. 4 attached to each other, in accordance with some embodiments.
Figure 10:
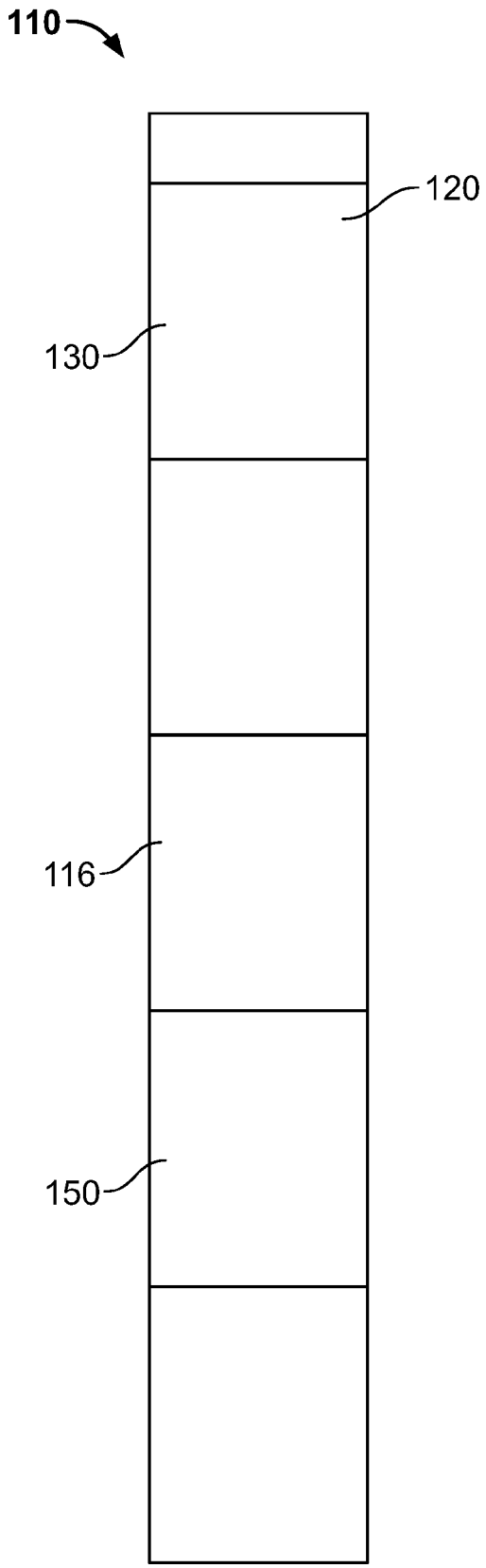
FIG. 10 is a front view of the product signage assembly of FIG. 1.

Referring now to FIG. 9, in some embodiments, two or more signage portions 120 are positioned side by side (see FIG. 1 for example). In some embodiments, when two signage portions 120 are positioned side by side, the adjacent edges of the signage portions 120 are secured to each other using one or more joining clips 190. In the example shown, the joining clips 190 are secured to the edges of the upper sign panels 130 together; however, it should be understood that joining clips 190 are configured to secure both upper sign panels 130 and lower sign panels 150 to adjacent upper sign panels 130 and lower sign panels 150. The joining clips 190 help to ensure that the signage portions 120 remain in an operable position with respect to each other and that no gap is visible between the two signage portions 120. In some embodiments, means other than joining clips 190 are used to secure adjacent edges of signage portions 120 to each other. For example, fasteners, VELCRO, double-sided tape, or putty are used to secure adjacent signage portions 120 to each other.

Referring now to FIGS. 10-15, in accordance with some embodiments, an assembled product signage assembly 110 includes the signage portion 120 (see FIG. 10) comprising the upper sign panel 130 and the lower sign panel 150. As previously described, in some embodiments, the front face of the signage portion 120 is outfitted with transparent receiving sleeves 116 for receiving image-bearing panels or display members 114. In some embodiments, the images displayed on the panels correspond to images borne on products located near the product signage assembly 110. For example, the product signage assembly 110 is attached to a product display shelf apparatus and the images displayed on panels inserted in the transparent receiving sleeves 116 correspond to images borne on backpacks arranged on the product display shelf apparatus.

Figure 11:
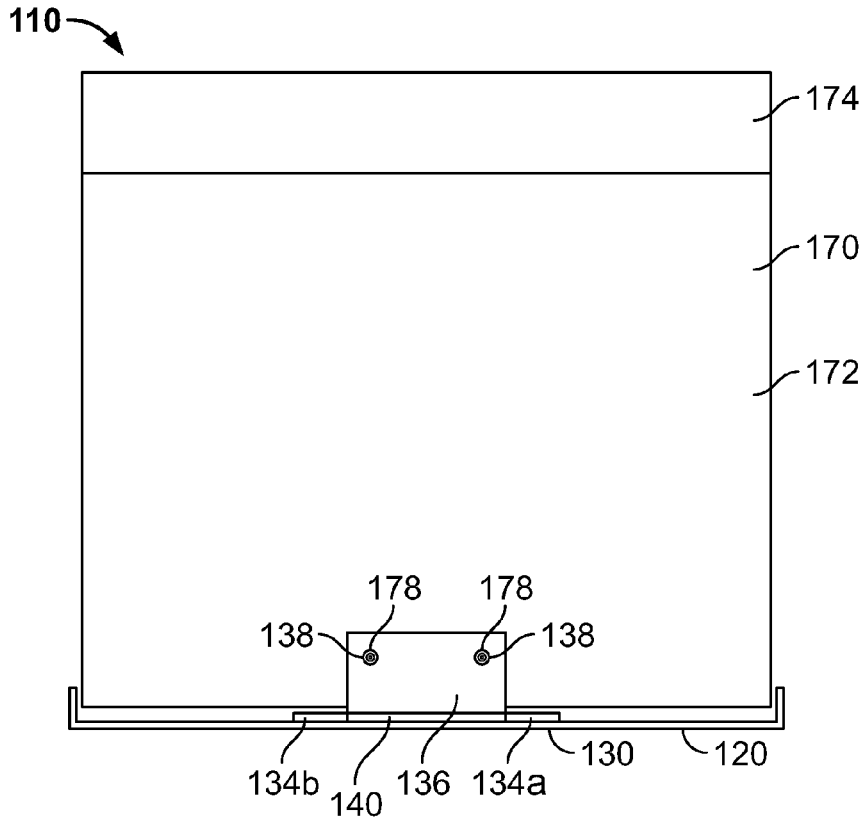
FIG. 11 is a top view of the product signage assembly of FIG. 10.

Referring to FIG. 11, a top view of the product signage assembly 110 shows that the signage portion 120 includes the rear bracket 136 extending from the upper sign panel 130. The rear bracket 136 is slidably coupled to the upper sign panel 130. The rear bracket 136 is positioned within the channel 132 formed by the guide rails 134*a* and 134*b*. The rear bracket 136 couples the signage portion 120 to one of the mounting portions 170. The apertures 138 of the rear bracket 136 engage fasteners 178 extending through the apertures 176 of the mounting portion 170. The mounting portion 170 consists of the front mounting portion 172 which partially overlays the rear mounting portion 174. The mounting portion 170 is configured to securely engage a shelf of a retail display as described above with reference to FIGS. 5-7.

Figure 12:
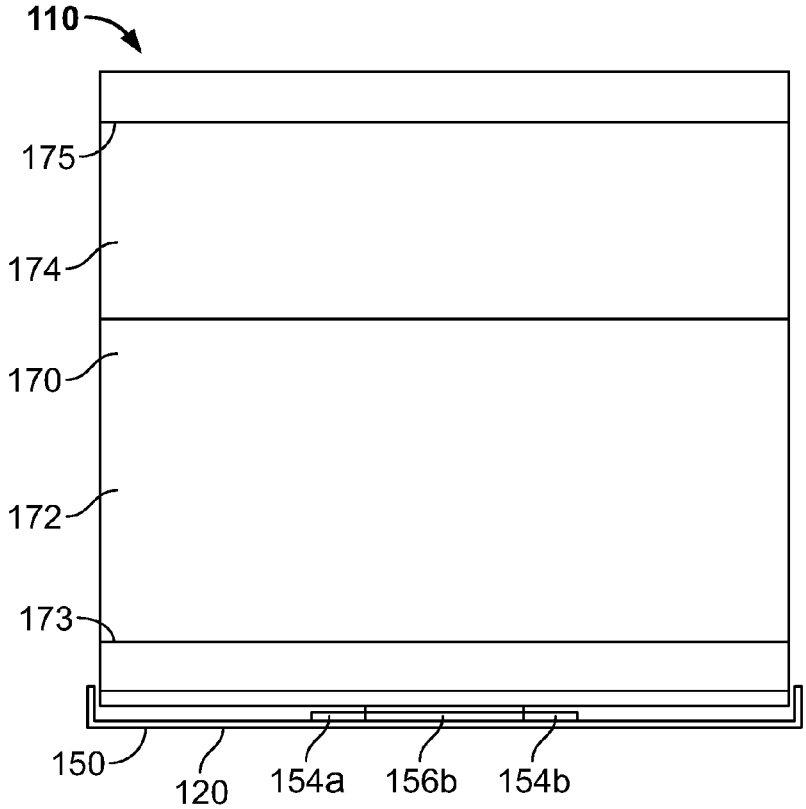
FIG. 12 is a bottom view of the product signage assembly of FIG. 10.

Referring now to FIG. 12, a bottom view of the product signage assembly 110 shows that the signage portion 120 is coupled to another mounting portion 170. The rear bracket 156*b* extends from the lower sign panel 150 and couples to the mounting portion 170 as described above. The mounting portion 170 includes the front mounting portion 172 and the rear mounting portion 174. The front mounting portion 172 defines the channel 173 for engaging a front face of a shelf and the rear mounting portion 174 defines the channel 175 for engaging a rear face of the shelf as described above with reference to FIGS. 5-7. The position of the rear mounting portion 174 with respect to the front mounting portion 172 is adjustable to allow the mounting portion 170 to be configured to engage shelves of varying depths.

Figure 13:
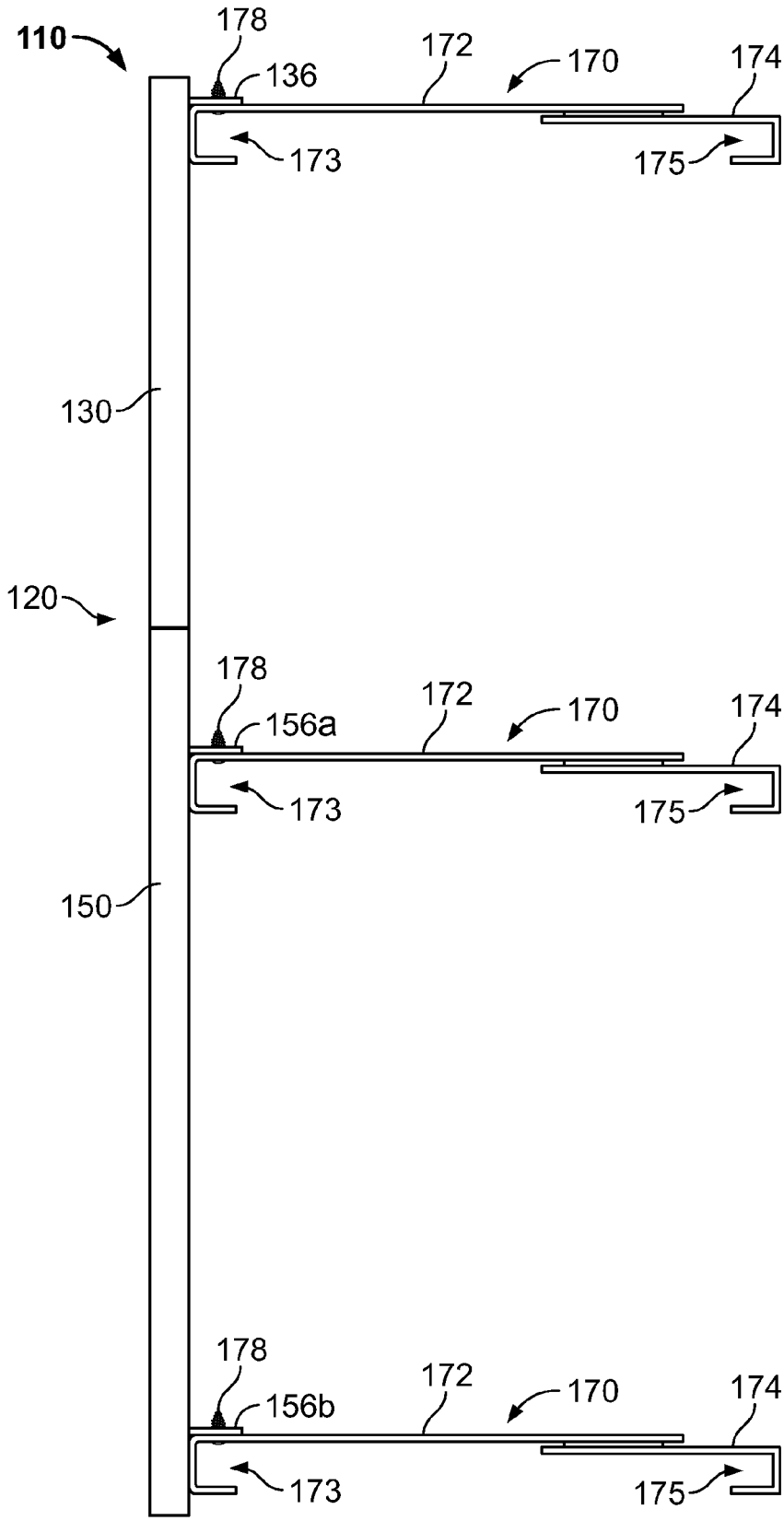
FIG. 13 is a side view of the product signage assembly of FIG. 10.
Figure 14:
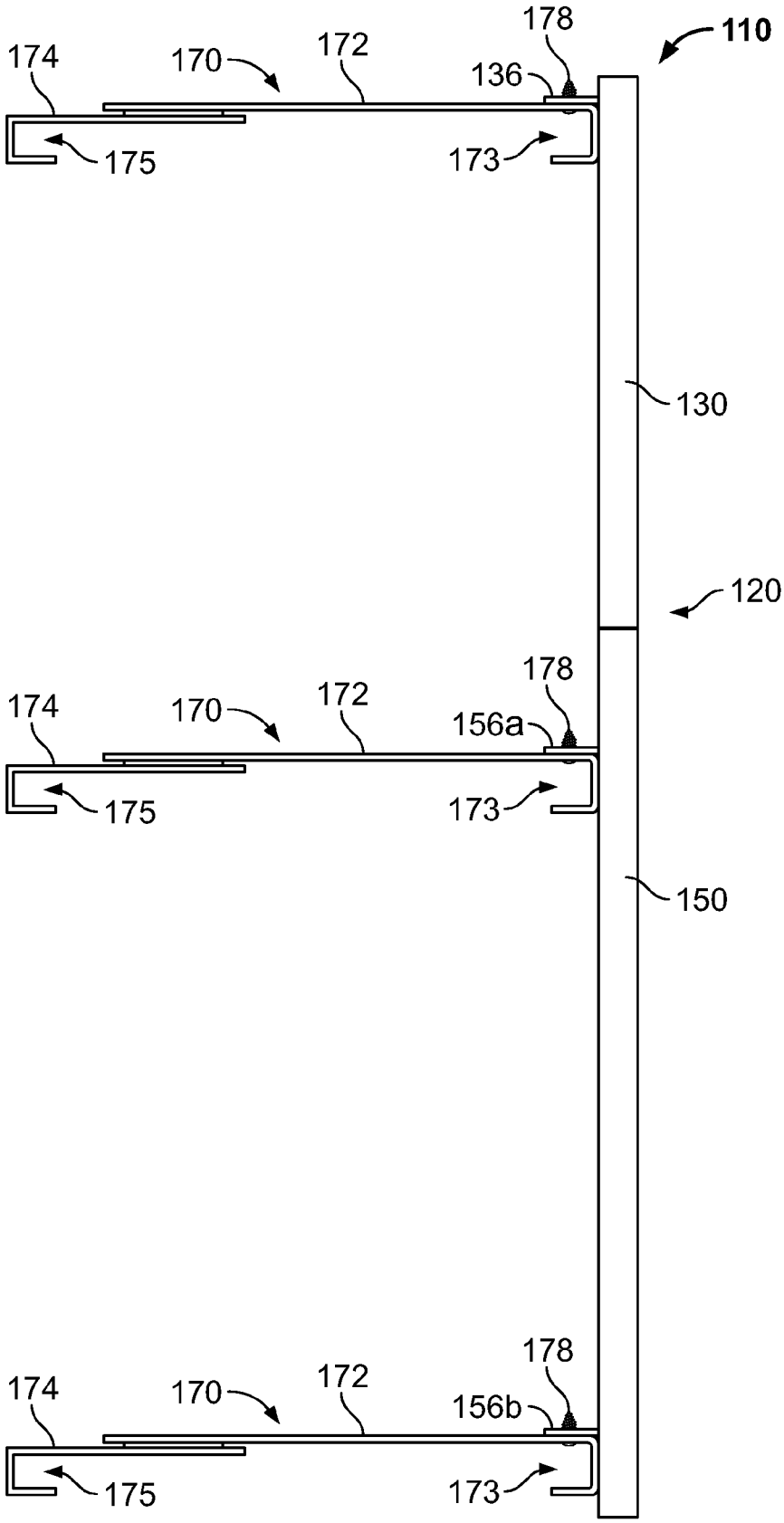
FIG. 14 is a side view of the product signage assembly of FIG. 10.
Figure 15:
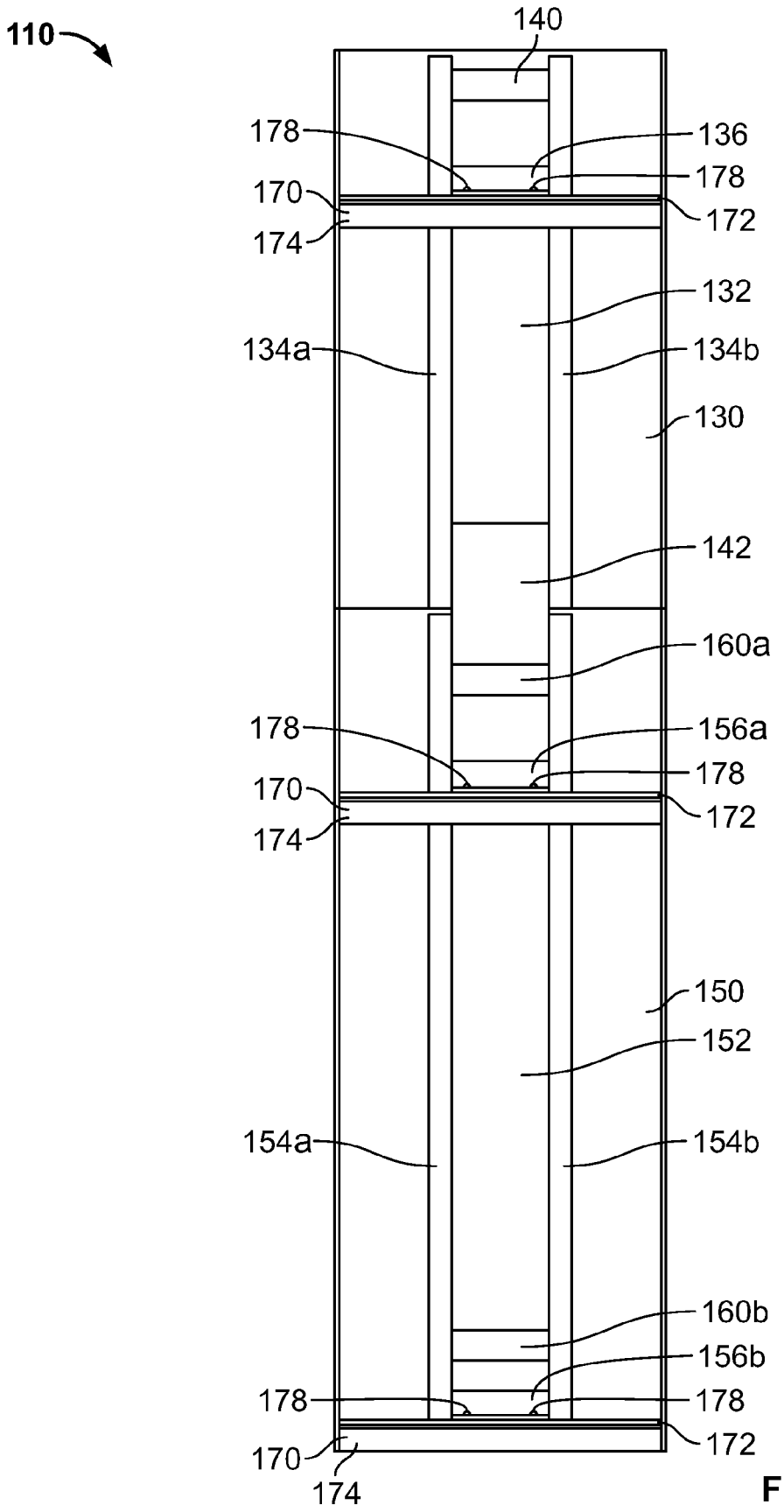
FIG. 15 is a rear view of the product signage assembly of FIG. 10.

Referring now to FIGS. 13-15, side views (FIGS. 13-14) and a rear view (FIG. 15) of the product signage assembly 110 show that the signage portion 120 is coupled to three mounting portions 170. The mounting portions 170 are configured to engage shelves of a product display shelf apparatus in order to hold the product signage assembly 110 in an operable position. The signage portion 120 is coupled to the mounting portions 170 by rear brackets 136 and 156*a-b*. The apertures 138 and 158 of the rear brackets 136 and 156*a-b* engage fasteners extending from the apertures 176 of the mounting portions 170. In some embodiments, the vertical positions of some or all of the rear brackets 136 and 156*a-b* are adjustable to allow the product signage assembly 110 to be mounted to shelves of varying heights. In some embodiments, the product signage assembly 110 includes more or less than three rear brackets and three mounting portions. In some embodiments, the number of rear brackets of the product signage assembly 110 is equivalent to the number of mounting portions of the product signage assembly 110.

Figure 16:
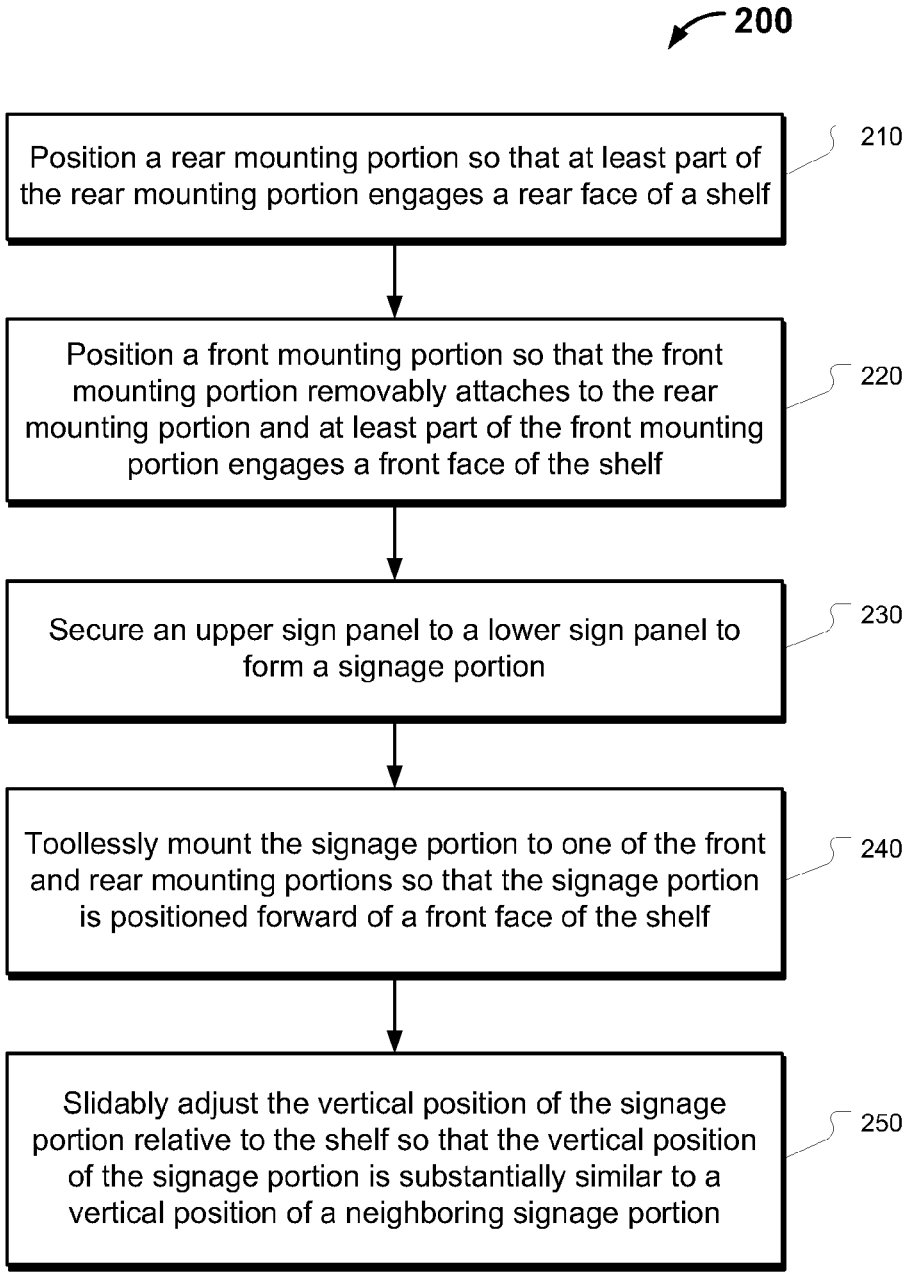
FIG. 16 is a flow chart of an example process for securing a product signage assembly to at least one shelf, in accordance with some embodiments.

Referring now to FIG. 16, some embodiments of a process 200 for assembling the product display shelf apparatus include securing at least one product signage assembly to at least one shelf. In this embodiment, the process 200 includes an operation 210 of positioning a rear mounting portion so that at least part of the rear mounting portion engages a rear face of a shelf. For example, referring to FIG. 6, the rear mounting portion 174 is positioned so that the channel 175 partially surrounds a rear portion of the shelf 102. The rear mounting portion 174 engages upper, rear, and lower surfaces of the shelf 102. In some embodiments, the rear mounting portion 174 forms a friction fit with the shelf 102.

In operation 220, a user positions a front mounting portion so that the front mounting portion removably attaches to the rear mounting portion and at least part of the front mounting portion engages a front face of the shelf. For example, referring to FIG. 6, the front mounting portion is positioned so that a portion of the front mounting portion 172 partially overlies the rear mounting portion 174. The channel 173 receives a front portion of the shelf 102. The front mounting portion 172 engages upper, front, and lower surfaces of the shelf 102. In some embodiments, the front mounting portion 172 forms a friction fit with the shelf 102. In some embodiments, the rear mounting portion 174 is positioned to partially overlie the front mounting portion 172. For example, in some embodiments of the process 200, operation 220 is performed before operation 210 so that the rear mounting portion removably attaches to the front mounting portion by partially overlying the front mounting portion. In some embodiments, neither of the front and rear mounting portions 172 and 174 overlies the other. For example, edges of the front and rear mounting portions 172 and 174 contact each other and are held together using fasteners, clips, tape, or adhesive.

Optionally, in operation 230, the user secures an upper sign panel to a lower sign panel to form a signage portion. For example, referring to FIG. 4, the upper sign panel 130 is positioned above the lower sign panel 150 so that front faces of the upper and lower sign panels 130 and 150 are aligned. The upper sign panel 130 is then lowered so that the tab 142 disposed within the channel 132 comes in contact with the lower sign panel 150 and engages the channel 152 of the lower sign panel 150. In some embodiments, the tab 142 forms a friction fit with the channel 152 in order to secure the upper sign panel 130 to the lower sign panel 150. In some embodiments, multiple tabs are used to secure the upper sign panel 130 to the lower sign panel 150. In some embodiments, fasteners are used to secure the upper sign panel 130 to the lower sign panel 150. In some embodiments, the upper sign panel 130 is welded or otherwise permanently bonded to the lower sign panel 150. In alternative embodiments, the signage portion 120 is integrally formed as a unitary molded structure.

In operation 240, the user toollessly mounts the signage portion to one of the front and rear mounting portions so that the signage portion is positioned forward of a front face of the shelf. For example, referring to FIG. 8, the apertures 158 of the rear mounting bracket **156*b* are aligned with the fasteners 178 extending through the apertures 176 of the front mounting portion 172. In some embodiments, the fasteners 178 are friction-fit fasteners that allow the lower sign panel 150 to be toollessly mounted to the mounting portion 170. In such embodiments, the rear mounting bracket 156*b* is lowered onto the friction-fit fasteners which in turn engage the rear mounting bracket 156*b* with a friction fit and hold the lower sign panel 150 in an operable position. As another example, rear brackets of the signage portion extend in a rearward direction from the rear surface of the signage portion so as to engage fasteners extending from the rear mounting portion. In this example, the rear mounting portion includes apertures for receiving fasteners which engage the rear brackets of the signage portion. Referring to FIG. 2, when the signage portion 120 is attached to the mounting portions 170 in an operable position, the signage portion 120 is positioned in front of a front face of the shelves 102**.

In operation 250, the user slidably adjusts the vertical position of the signage portion relative to the shelf so that the vertical position of the signage portion is substantially similar to a vertical position of a neighboring signage portion. For example, referring to FIG. 4, the rear bracket **156*a* is positioned within the channel 152 so that a distance between the rear bracket 156*b* and the rear bracket 156*a* is the same as the vertical distance between two shelves of a product display shelf apparatus. This allows the rear brackets 156*a*-*b* to engage mounting portions 170 attached to the shelves. In some embodiments, rear brackets 136, 156*a*, and 156*b* are repositioned within the channels 132 and 152 so that the vertical position of the signage portion 120 is substantially similar to a vertical position of another signage portion. For example, referring to FIG. 1, multiple product signage assemblies 110 are attached to the product display shelf apparatus 100. In the example depicted, each of the product signage assemblies 110 has a substantially similar vertical position, thus providing an attractive appearance for the product display shelf apparatus 100. In some embodiments, the shelves 102 of the product display shelf apparatus 100 are positioned at various different vertical heights. In such circumstances, rear mounting brackets of the product signage assemblies 110 are positioned at different positions within their respective channels in order for the signage portions of the product signage assemblies 110** to be arranged at substantially similar vertical positions. For example, if a first shelf is positioned one inch higher than a second shelf, a rear mounting bracket of a first product signage assembly attached to the first shelf can be positioned one inch higher than a rear mounting bracket of a second product signage assembly attached to the second shelf so that signage portions of the first and second product signage assemblies have substantially similar vertical positions.

It should be understood that the operations of the process can be performed in orders other than the order shown in FIG. 16. For example, operation 230 of securing the upper and lower sign panels to each other can optionally be performed before operations 220 or 210. As another example, operation 220 of positioning the front mounting portion can optionally be performed before operation 210 of positioning the rear mounting portion.

A number of embodiments of the invention have been described. Nevertheless, it will be understood that various modifications may be made without departing from the spirit and scope of the invention. Accordingly, other embodiments are within the scope of the following claims.

What is claimed is:

1. A product display shelf apparatus, comprising:

a substantially horizontal shelf having an upper surface to support a plurality of products bearing one or more graphic images;

a rear mounting portion that engages a rear face of the substantially horizontal shelf;

a front mounting portion being releasably coupled to the rear mounting portion and engaging a front face of the substantially horizontal shelf;

one or more vertical panels having transparent display portions that removably retain graphic panels bearing images that generally match with the one or more graphic images borne by the plurality of products; and one or more rear brackets slidably attached to the one or more vertical panels, wherein the rear brackets engage the front mounting portion to hold the one or more vertical panels in an operative position generally perpendicular to the substantially horizontal shelf and forward of the front face of the substantially horizontal shelf;

wherein the graphic panels retained by the one or more vertical panels are positioned forward of the front face of the substantially horizontal shelf and extend in a plane generally parallel to the front face of the substantially horizontal shelf, the front mounting portion is releasably coupled to the rear mounting portion with a toolless connector, and the tooless connector is a fabric hook and loop fastener.

2. The apparatus of claim 1, wherein the one or more rear brackets are slidably attached to one or more vertical channels defined by the one or more vertical panels so that a vertical position of each vertical panel is adjustable relative to the substantially horizontal shelf.

3. The apparatus of claim 2, wherein the one or more vertical panels comprise at least a first vertical panel and a second vertical panel, the vertical position of the first vertical panel relative to the substantially horizontal shelf being substantially similar to the vertical position of the second vertical panel relative to the substantially horizontal shelf.

4. The apparatus of claim 1, in combination with the plurality of products and the graphic panels, wherein the graphic panels are viewable to a consumer and display the images that generally match with the one or more graphic images borne by the plurality of products when the one or more graphic images borne by the plurality of products are non-viewable to the consumer.

5. The apparatus of claim 1, wherein at least a portion of the rear mounting portion rests on the upper surface of the substantially horizontal shelf while engaging the rear face of the substantially horizontal shelf, and at least a portion of the front mounting portion rests on the upper surface of the substantially horizontal shelf while engaging the front face of the substantially horizontal shelf.

6. The apparatus of claim 5, wherein the rear mounting portion defines a friction-fit channel that engages the rear face of the substantially horizontal shelf, a top surface of the substantially horizontal shelf, and a bottom surface of the substantially horizontal shelf, and the front mounting portion defines a friction-fit channel that engages the front face of the substantially horizontal shelf.

7. A display apparatus, comprising:

a plurality of shelves each having a substantially horizontal surface to support a plurality of products bearing one or more images, at least one of the shelves being arranged vertically above another of the shelves; and first and second product signage assemblies that are horizontally spaced apart relative to one another, each of the first and second product signage assemblies comprising:

a shelf mounting assembly that releasably engages a rear face, a front face, and the substantially horizontal surface of a corresponding shelf of the plurality of shelves;

a signage retainer member mounted to the shelf mounting assembly in a vertical orientation and being positioned forward of the plurality of shelves so as to span a vertical height greater than two of the plurality of shelves;

a plurality of generally planar display members removably coupled to the signage retainer member in a generally vertical array;

wherein:

a first signage retainer member of the first signage assembly is slidably adjustable relative to the corresponding shelf so that a vertical position of the first signage retainer member is substantially similar to a vertical position of a second signage retainer member of the second product signage assembly, and the plurality of generally planar display members of the first product signage assembly are each removably coupled to the first signage retainer member and are positioned forward of the front face of the corresponding shelf, wherein each of the plurality of generally planar display members defines a substantially planar front surface extending substantially entirely in a plane substantially parallel to the front face of the corresponding shelf; and one or more slidable arms coupled to the first signage retainer member, the one or more slidable arms being slidably attached to a channel defined by the first signage retainer member so that the vertical position of the first signage retainer member is slidably adjustable relative to the corresponding shelf;

wherein each shelf mounting assembly comprises a rear element to engage the rear face of the corresponding shelf and a front element to engage the front face of the corresponding shelf, and the front element is releasably coupled to the rear element with a toolless connector.

8. The apparatus of claim 7, in combination with the plurality of products supported on the plurality of shelves, wherein the plurality of generally planar display members have images thereon that are substantially identical to the one or more images borne by the plurality of products supported by the plurality of shelves, and the generally planar display members coupled to each signage retainer member are viewable to a consumer when the one or more images borne by the plurality of products supported by the plurality of shelves are non-viewable to the consumer.

9. The apparatus of claim 6, wherein:

the rear mounting portion includes a first substantially planar panel forwardly extending from the friction-fit channel defined by the rear mounting portion, the front mounting portion includes a second substantially planar panel rearwardly extending from the friction-fit channel defined by the front mounting portion, and the first substantially planar panel of the rear mounting portion and the second substantially planar panel of the front mounting portion overlap and are secured to one another.

10. The apparatus of claim 6, wherein at least one of the friction-fit channel defined by the rear mounting portion and the friction-fit channel defined by the front mounting portion includes grip pads on an inner surface thereof for directly interfacing with the substantially horizontal shelf.

11. A product display shelf apparatus, comprising:

a substantially horizontal shelf having an upper surface to support a plurality of products bearing one or more graphic images;

a rear mounting portion that engages a rear face of the substantially horizontal shelf a front mounting portion being releasably coupled to the rear mounting portion and engaging a front face of the substantially horizontal shelf;

one or more vertical panels having transparent display portions that removably retain graphic panels bearing images that generally match with the one or more graphic images borne by the plurality of products; and one or more rear brackets slidably attached to the one or more vertical panels, wherein the rear brackets engage the front mounting portion to hold the one or more vertical panels in an operative position generally perpendicular to the substantially horizontal shelf and forward of the front face of the substantially horizontal shelf;

wherein:

the substantially horizontal shelf defines a lower surface, which is positioned opposite the upper surface of the substantially horizontal shelf, and a side surface extending substantially perpendicularly with respect to the upper surface of the substantially horizontal shelf, and the apparatus further comprises a shelf clip including:

a top extending portion extending over one of the rear mounting portion and the front mounting portion, a middle extending portion extending downwardly from the top extending portion alongside the side surface of the substantially horizontal shelf, and a bottom extending portion contacting the lower surface of the substantially horizontal shelf opposite the upper surface of the substantially horizontal shelf.

12. The apparatus of claim 1, wherein the graphic panels are received via a side edge of a corresponding one of the one or more vertical panels.

13. The apparatus of claim 1, in combination with the plurality of products and the graphic panels.

14. The apparatus of claim 13, wherein the plurality of products are shirts, and the images on the graphic panels are substantially identical to the one or more graphic images borne by the plurality of products.

15. The apparatus of claim 1, wherein the graphic panels each define a substantially planar rear surface, the substantially planar rear surface of each of the graphic panels extending in front of and in a plane substantially parallel to the front face of the substantially horizontal shelf.

* * * * *